US005318096A

United States Patent [19]

McKibben et al.

[11] Patent Number: 5,318,096

[45] Date of Patent: Jun. 7, 1994

[54] REMOVABLE PLATE ASSEMBLY FOR CORE MACHINE HEAD

[75] Inventors: Kenneth D. McKibben, Defiance, Ohio; Thomas E. Wuepper, Alger; Al Gould, Au Gres, both of Mich.

[73] Assignee: CMI International, Inc., Southfield, Mich.

[21] Appl. No.: 950,814

[22] Filed: Nov. 27, 1992

[51] Int. Cl.[5] ..... B22C 13/12; B22C 15/24

[52] U.S. Cl. ..... 164/201; 164/186

[58] Field of Search ..... 164/169, 186, 195, 200, 164/201, 202

[56] References Cited

U.S. PATENT DOCUMENTS

| | | | |
|---|---|---|---|
| 823,530 | 6/1906 | Hewlett | 164/202 |
| 2,705,821 | 4/1955 | Peterson | 164/202 |
| 2,779,071 | 1/1957 | Herbruggen | 164/200 X |
| 2,789,325 | 4/1957 | McKee | 164/202 |
| 3,007,215 | 11/1961 | Demmler et al. | 164/202 |
| 3,540,521 | 11/1970 | Buck, Jr. et al. | 164/202 |
| 4,140,171 | 2/1979 | Michelson | 164/169 X |
| 4,942,916 | 7/1990 | Hale et al. | 164/186 |

FOREIGN PATENT DOCUMENTS

| | | | |
|---|---|---|---|
| 48-9250 | 3/1973 | Japan | 164/200 |
| 603485 | 4/1978 | U.S.S.R. | 164/201 |

*Primary Examiner*—J. Reed Batten, Jr.
*Attorney, Agent, or Firm*—Harness, Dickey & Pierce

[57] ABSTRACT

A blow head or gassing head of an automatic core machine, which produces sand casting cores in a core box is formed of a downwardly opening box-like frame having a bottom closure plate. The heads may be alternatively used to respectively deposit a sand and binder material or to flow gas into a sand-filled core box cavity positioned beneath the head. The closure plates are provided with openings through which either the sand-binder material may drop from the blow head frame into the core box cavity or through which gas may flow from the gassing head frame into the cavity. The plate is loosely positioned beneath the frame and is clamped tightly upwardly against the bottom peripheral edge of the head by a spaced pair of elongated, rigid rails which engage and support the opposite side edges of the plate. A rail holding a clamping mechanism selectively moves the rails upwardly for clamping the plate against the frame and downwardly to free the plate relative to the frame. The rails are lowered when the openings in the plates become partially or fully obstructed or when different opening patterns are required so that the plate may be slid horizontally from beneath the frame and a substitute plate may be slid upon the rails beneath the frame and then clamped upwardly against the frame edges.

12 Claims, 3 Drawing Sheets

REMOVABLE PLATE ASSEMBLY FOR CORE MACHINE HEAD

BACKGROUND OF THE INVENTION

This invention relates to a removable blow head plate or gassing head plate for an automatic core machine sand blow head or gassing head or both, which machine is used to mold sand cores used in foundry casting of metal.

Conventional foundry casting generally comprises forming either a temporary sand mold or a permanent metal mold with one or more cavities into which molten metal is poured. The metal solidifies within the cavity and is removed to form a cast article. Where the article is hollowed or provided with openings, it is conventional to use a core which is arranged within the cavity so that the molten metal poured into the cavity solidifies around the core. Then, the core is broken and removed to leave the opening or hollow area within the article.

In general, the cores are formed by using shell core or hot box or cold box (utilizing gas) techniques. For example, in shell core or hot box core forming techniques, sand which is pre-coated with a binder of wax or resin or the like material, is dropped into the cavity in a core box mold for molding the sand into the shape of the desired core. The binder may be activated by using a self activating binder and catalyst mixture, which activates at room temperature, or by heating the core box to activate a binder mixture.

Where the cold box technique is used, a conventional gas, such as $CO_2$, is blown into the mixture of sand and binder in the cavity to cause a chemical reaction which solidifies the sand and binder to form the solid molded core shape. Some variations of these techniques are utilized, in general, to cause the binder to activate either within a pre-determined time period.

Automatic machinery is utilized to rapidly form cores within cavities in core boxes, utilizing one or another of the above types of core forming techniques. These automatic machines typically include a sand hopper which stores sand and feeds the sand downwardly as required. A blow head is located beneath the hopper, essentially a container or box-like frame, that receives a charge of sand from the reservoir of sand. Sand is dropped downwardly through openings in a closure plate secured to the bottom of the blow head frame. The sand passing openings are aligned with corresponding portions of the core mold cavity in the core box located beneath the blow head.

Where a cold box or gassing technique is utilized, the machine may also have a gas storage container which feeds gas into a gassing head which is constructed similarly to the blow head and has a similar closure plate fastened to the bottom of the gassing box-like frame. The gas passes through openings in the gassing head closure plate and downwardly into a sand filled cavity in the core box located beneath the head.

Where the gassing technique is utilized, the automatic machine is provided with a mechanism for, first, locating a core box beneath the blow head for filling with sand and, then, for moving the core box beneath the gassing head for applying the gas for reacting the binder and setting the sand-binder mixture into the desired core shape. Where the hot box or shell technique is utilized, that is, where the binder is either set by a time related reaction or by the application of heat, the automatic machine may have only a blow head beneath which one or more core boxes may be positioned.

In the foregoing types of automatic core forming machines, the openings in the blow head or gassing head plates tend to become partially or fully plugged by accumulating solidified sand-binder material and, sometimes, the sand above and around the upper portions of the openings in the plate tends to crust or solidify. This occurs because, in the case of a heat setting binder, the heat rises and causes a reaction in the sand-binder mixture located above and around the openings during the times that the core sand-binder material is setting within the core cavity. In the case of the gassing heads, sometimes the sand binder material in the core raises or spills upwardly sufficiently to accumulate material in and around the plate openings to partially or fully plug them.

It can be seen, that over a period of time, the partial or full plugging of the openings in the plates adversely effect the filling of the core cavities and the proper setting of the core-binder mixtures in the core cavities. Hence, when that occurs, in conventional equipment, the automatic machine must be shut down and cooled. Then, the blow head or the gassing head or both must be manually removed from the machine. The lower plates, which are secured as closures, upon the frames must be cleaned and, then, the heads replaced. Where a different hole or opening pattern is needed for use with changed cavity arrangements within the core box, the plates must be unfastened from their frames and replaced. Typically, fastening involves the use of screws or similar types of mechanical fastening means which take considerable time for releasing and then reapplication for plate substitution. The replacement of the plates requires that the heads be cooled enough for manual contact.

Thus, the invention of this application is concerned with providing an assembly by which the closure plates, referred to as blow plates or gassing plates, of the blow head or gassing head of an automatic core forming machine may be replaced rapidly, without shutting down the machine more than short period of time, and without the necessity of cooling the machine. Hence, the plates can be replaced often to ensure that the opening are not obstructed or plugged.

SUMMARY OF THE INVENTION

This invention contemplates a removable plate assembly for the blowing head or gassing head of an automatic core forming machine. The respective heads in general comprise a box-like frame having an open bottom upon which a closure pate is camped for closing the bottom of the head. The plate is provided with openings located in pre-determined positions to correspond to the core forming cavity or cavities in the core box located beneath the head. The plate is loosely positioned beneath the respective head. That is, it is clamped upwardly against the bottom edges of the head frame. When unclamped, the plate is arranged to be lowered from the frame so that it may be moved horizontally away from the frame and replaced with another closure plate.

The preferred structure contemplated comprises a pair of generally L-shaped in cross-section elongated rails having vertical legs positioned within channels formed in the lower edges of the head frame and horizontal legs arranged beneath and supporting the edge portions of the plate. These rails may be raised or lowered by fastening or clamping mechanisms mounted on the head and connected to the rails.

In one form, the rails may be moved upwardly and downwardly relative to the frame by means of clamping mechanisms located at opposite ends of the frame and connected to both ends of the rails. Another form contemplated involves pivoting one end of each of the rails while moving the opposite end upwardly and downwardly by the fastening mechanism. In either event, the plates may be loosely moved horizontally outwardly from beneath their frames when desired for replacement. Thus, the plates may be rapidly cleaned or replaced with different hole pattern plates, without the necessity for cooling the equipment or disassembling the heads from the machines.

An object of this invention is to provide a rapidly removable plate assembly system by which the blow plate or gassing plate may be removed very rapidly from the respective blow or gassing headings without the need for cooling the equipment or for removing the heads from the equipment for the replacement of plates with either clean or different hole pattern plates as required.

A further object of this invention is to provide a relatively inexpensive way of removably mounting the closure plates from a blow head or gassing head of an automatic core forming machine with minimal labor for removal and replacement of plates and with minimum down time for such replacement.

Another object of this invention is to provide a means for immediately replacing a blow head place or a gassing head plate whenever it appears that their passageways or openings are obstructed without substantially interfering with the continuous production of the sand cores formed in the sand box of the automatic core forming machine.

Still a further object of this invention is to provide an assembly for an automatic core forming machine which enables rapid cleaning of the blow plate and the gassing head plate, where a gassing head is used, with minimal labor and minimal machine down time.

These and other objects and advantages of this invention will become apparent upon reading the following description of which the attached drawings form a part.

DETAILED DESCRIPTION OF THE PREFERRED EMBODIMENT

Figure 1:
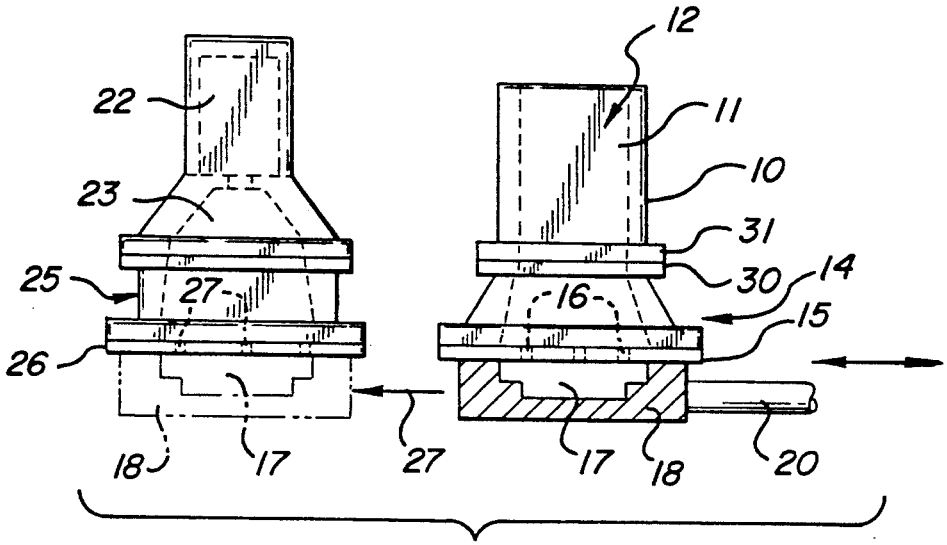
FIG. 1 is a schematic view of an automatic core making machine with a blow head and gassing head and core box schematically positioned for illustrative purposes.

FIG. 1 schematically illustrates, partially in cross-section, a portion of an automatic core forming machine. Machines of this type are conventional and, therefore, only several portions thereof are schematically illustrated in order to show the closure plate assembly of this invention, Turning to FIG. 1, the machine includes a sand magazine or reservoir 10 containing a quantity of sand 11 which is poured in, as schematically represented by the arrow 12. The sand may be formed of granules that are individually coated with a binder material or which may be mixed with a dry powder binder, depending upon the technique utilized in forming the cores. For purposes of this description, the term sand or sand and binder material refers to the sand with either a separate binder added or with a coating of a binder material.

Mounted beneath the sand magazine is the blow head 14 which essentially is shaped like a box or a frame, as will be described below. The particular shape and size may be varied.

The box 14, which is schematically illustrated in the form of a truncated, conical, square sided frame, is open at its bottom. The bottom is closed with a closure plate or blow head plate 15. That plate has numerous openings 16 at pre-determined locations for the flow of sand through the openings into a cavity 17 in a core box 18.

The core box 18 is schematically shown in cross-section with a schematically illustrated core cavity which receives sand and binder for the molding of a core. The core box 18 may be moved into and out of place beneath the blow plate or closure plate 15 by a suitable transfer mechanism which is schematically illustrated in the form of a reciprocating rod 20 attached to the core box for movement horizontally, in this case, to position the core box appropriately beneath the blow head.

In those types of machines where a gassing head is also used for flowing a gas, such as carbon dioxide or some other suitable gas, into the sand filled cavity of the core box (shown in dotted lines), a gas reservoir or container 22 is provided. This is schematically illustrated as being mounted upon a manifold or chamber 23. The chamber is secured to the upper end of a gassing head 25 which, for purposes of illustration, is shown to be similar in construction to the blow head 14. As in the case of the blow head 14, the box-like frame which forms the gassing head 25 is provided with a lower closure plate or gassing plate 26 having holes 27 through which the gas may flow into the core box cavity 17.

As illustrated by the arrow 27, the core box may be moved by the transfer mechanism from the location beneath the blow head, where it is filled with sand, to the location beneath the gassing head where gas may be applied for chemically actuating the binder and setting the sand-binder mixture to form the solid core.

For descriptive purposes, the gassing head and gassing plate are described in conjunction with the description of the blow head and blow head plate. Thus, it will be assumed that, although their detailed constructions are somewhat different, for illustrative purposes, they are essentially the same.

Figure 2:
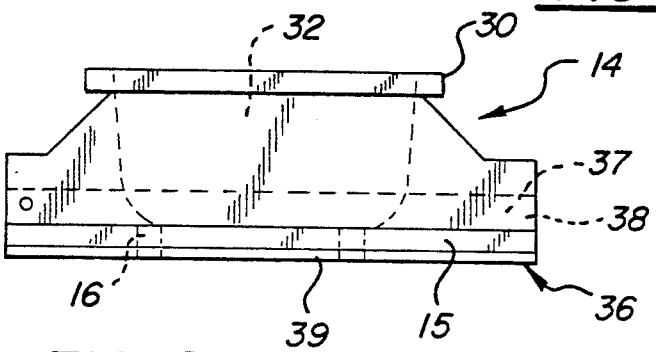
FIG. 2 is a schematic view of a blow head with the closure or blow plate in operating position.

Turning to FIG. 2, the blow head 14 is provided with an upper attachment flange 30 for bolting or otherwise fastening to the corresponding flange 31 on the sand magazine. The interior of the box-like frame which forms the blow head 14 forms a hopper-like portion 32 for containing a charge of sand for delivery to the core box. The open bottom of the frame is closed with a closure plate or blow plate 15 which is clamped upwardly against the bottom edges of the frame by means of rails 36. These rails are generally L-shaped in cross section. The vertical leg 37 of each rail extends into a channel 38 in the bottom edge of the frame. The horizontal leg 39 of each rail supports the adjacent edge portions of the closure plate 15 and clamps the plate upwardly against the lower edges of the frame.

Figure 3:
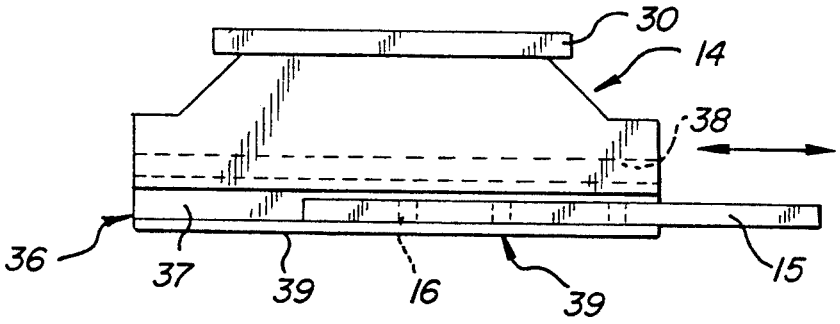
FIG. 3 is a schematic view, similar to FIG. 2, but showing the closure plate or blow plate partially removed.

FIG. 3 schematically shows the rails 36 lowered relative to their channels 38 so that the plate 15 is loosely positioned below the lower edges of the blow head frame. Therefore, the plate can be slid sidewise or horizontally outwardly and away from the blow head for substitution of another plate. The substitute plate may be a clean plate or a plate with different hole patterns, as required. FIG. 2 shows the plate 15 clamped upwardly against the lower edges of the blow head frame by means of the horizontal legs 39 of the rails 36.

Figure 4:
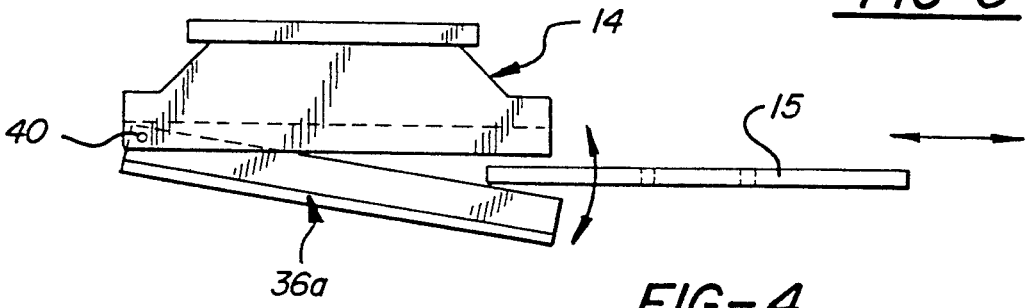
FIG. 4 is a view similar to FIGS. 2 and 3, but showing an alternative closure plate support rail pivoted downwardly for removal of the closure plate.
Figures 5, 6, 7:
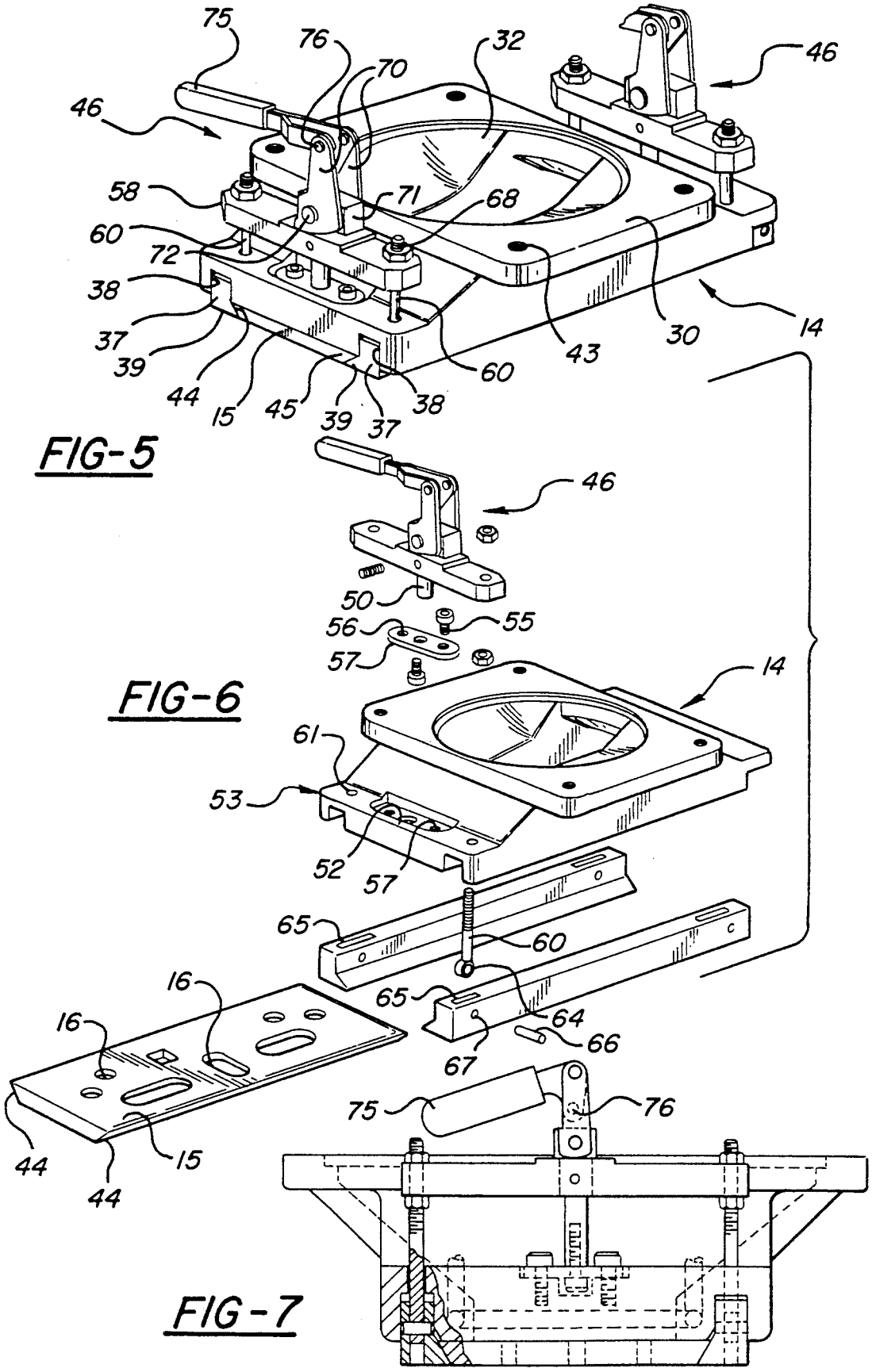
FIG. 5 is a perspective view of a blow head.
FIG. 6 is an exploded, perspective view of the blow head of FIG. 5.
FIG. 7 is an side elevational view partially in cross-section, showing the blow head in clamped-in-place position.

FIG. 4 shows a modified arrangement of the rails **36*a* which are pivoted by pivot pins 40 to the blow head. The rails 36 are pivoted downwardly to release the closure plate 15 which may then be moved horizontally from beneath the head and replaced with a substitute plate. Conversely, the rails 36*a*** may be swung upwardly to clamp the closure plate upwardly against the bottom edge of the head forming frame.

The foregoing describes, schematically, the general relationship between the closure plate, whether of the blow plate or gassing plate construction, and the respective heads with their sand or gas supply systems. Turning to the more detailed construction of one embodiment of the blow head 14, FIGS. 5–8 illustrate a double fastening or clamping construction for the closure plate. The drawings illustrate the blow head 14 with the upper flange 30 having apertures 43 to receive bolts for bolting the head to the lower portion of a sand magazine or the like. The hopper portion 32 may be generally funnel shaped for receiving and funneling sand downwardly to the bottom of the frame and through the openings 16 in the bottom closure plate. The drawings illustrate the rails with their horizontal legs 39 chamfered or sloped at 44 to engage against angled edges 45 of the closure plate 15.

Clamping assemblies or fasteners 46 are provided to move the rails upwardly and downwardly for clamping the closure plate 15. These fasteners generally comprise a central spindle 50 which is secured to a mounting plate 51 that, in turn, is bolted within a recess 52 on side extending flange portions 53 of the head. Suitable bolts or machine screws 55 extend through aligned apertures 56 and 57 in the recess for holding the bracket plate in place. The upper end of the spindle is connected to a horizontally arranged bar or base member 58 whose opposite ends carry bolt-like rods or posts 60. These posts extend through openings 61 and their lower ends which are provided with rings or eyelets 64 extend into slots 65 in the rails. The rings are pinned within the slots by pins 66 extending traversal through holes 67 in the rails for movably fastening the posts in place. The upper ends of the post are held to the base 58 by means of nuts 68.

Figure 8:
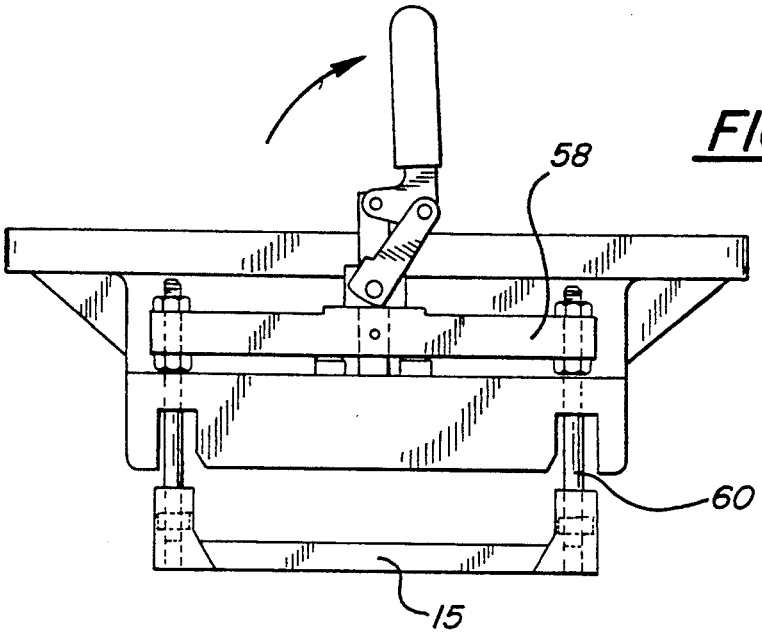
FIG. 8 is a side elevational view of the blow head with the support rails and the closure plate lowered into unclamped, removable, position.

Cam links 70 are pivotally connected to a block 71 mounted on the top of the base 58 by means of a pivot pin 72. These cam links are connected to a cam handle or lever 75 by pins 76. The cam lever is pinned to the block at 76 so that upon swinging of the lever 75 into a more horizontal direction, the posts rise up and the rails move upwardly to clamp the plate against the bottom of the frame. Conversely, when the lever is swung into an upright position as illustrated in FIG. 8, the post move downwardly along with the base 58 to lower the rails and the closure plate so that the plate is free of engagement to the frame. Then the plate may be horizontally slid out of place as indicated in FIG. 3.

In operation, when the blow head is bolted in place beneath the sand reservoir, the sand or sand or binder mixture or coated sand gravity drops into the funnel like portion of the head and then passes downwardly through the openings 16 in the closure plate and into the core box cavity. Whenever the openings become obstructed or plugged due to sand-binder clumps granules forming therein or crusting above the openings, the machine can be momentarily stopped. Then, the operator, by pulling the levers 75 upwardly, can lower the rails and unclamp the plate 15. Next, he may pull the plate 15 out sideways and immediately push a fresh, clean, spare plate into position. Finally, the clamp levers may be swung into a generally horizontal position which raises the rails and reclamps a plate into position beneath the frame of the head.

Figure 9:
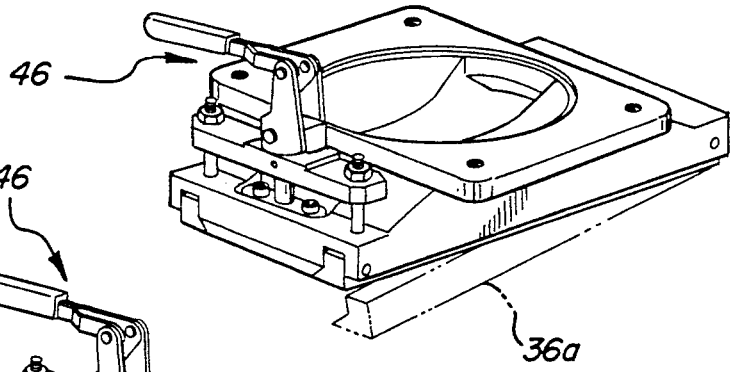
FIG. 9 shows a perspective view of a modification having a single fastening or clamping mechanism.
Figure 10:
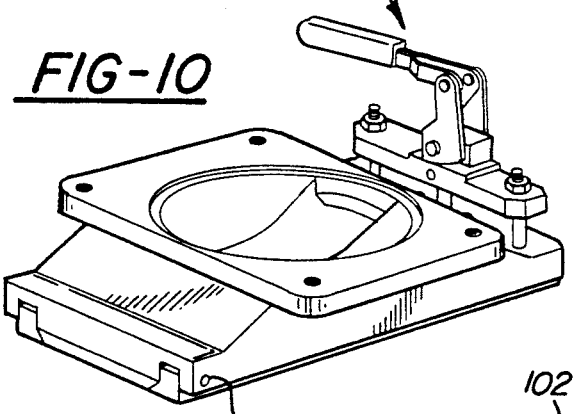
FIG. 10 is a rear, perspective view of the modification of FIG. 9, illustrating a rear view of the fastening mechanism.

FIGS. 9 and 10 show a modification, corresponding to the schematic view of FIG. 4, wherein a single clamp mechanism or fastener 46 is used to raise and lower one end of each of the rails. The other ends of the rails are pivoted within the frame by means of pivot pins 40. This is illustrated in dotted lines in FIG. 9 with the number **36*a*** indicating the downwardly pivoted rail. In this way, a single fastening mechanism may be utilized for releasing the closure plate.

Figure 11:
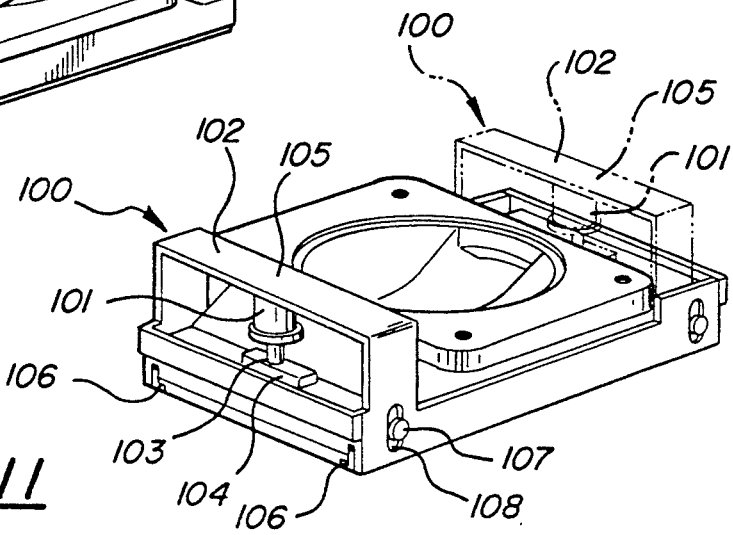
FIG. 11 is a perspective view of a further modification.

FIG. 11 shows another modification wherein the blow head and plate arrangement are substantially the same as described above. However, the fastening or clamping mechanism 100 is pneumatically operated. In this case, an air cylinder 101 is mounted on each of the opposite ends of the frame within housings 102. The pneumatic cylinders 101 have rods 103 which connect to bars 104 so that actuation of the cylinders 101 by pneumatic pressure from an air hose 105 causes the rails 106 to move upwardly and downwardly. The rails may be guided and positioned by means of sidewardly extending pins 107 arranged within elongated slots or openings 108. When the air pressure is oppositely activated, the plate is clamped in position as the rails raise upwardly. The specific details of this pneumatic construction may be varied in accordance with commercially available pneumatic moving apparatus.

The foregoing description should be read as illustrative of operative embodiments of this invention and not in a strictly limiting sense. Having fully described at least one operative embodiment of the invention, it is now claimed:

We claim:

1. A plate assembly for a core machine blow head or gassing head having a box-like generally horizontally arranged, downwardly opening frame formed of pairs of spaced apart side and end frame members, and with a closure plate covering the open bottom of the frame, and with the head normally arranged above a core box having a cavity within which a sand-binder material is molded, for depositing the material in the cavity or flowing gas into a filling of material in the cavity from the head through openings formed in the plate that are aligned with the cavity, comprising:

a pair of spaced apart plate support rails arranged at the bottom of the frame at opposite sides of the frame and having rail portions arranged beneath the opposite edges of the plate upon which portions the plate is loosely rested;

a fastener connecting the rails to the frame with the fastener being adjustable for raising and lowering the rails relative to the bottom of the frame and with said rails clamping and holding the plate upwardly against the bottom edges defining the frame when the rails are raised and lowering the plate beneath and out of contact with the frame when the rails are lowered;

said plate being slidable in a generally horizontal direction off the rails and laterally relative to the frame for removal of the plate when the rails are lowered, so that a substitute plate may be slid upon the rails and arranged beneath the frame for clamping upwardly against said frame bottom edges for thereby rapidly replacing one plate with another either when the openings become partially or fully obstructed or for providing a different pattern of openings when required.

2. A plate assembly as defined in claim 1 and said fastener comprising at least one clamp mechanism secured to the head and the rails with the clamp mechanism being movable into one position for raising the rails against the frame bottom edges and into a second position for lowering the rails beneath the frame bottom edges.

3. A plate assembly as defined in claim 2 and including a clamp mechanism mounted upon the frame at opposite ends thereof and engaging the opposite ends of the rails so that the rail ends may be simultaneously raised and lowered when desired.

4. A plate assembly as defined in claim 2, and including one end of each rail being pivotally connected to the frame with the clamp mechanism located at the opposite end of the rail for lowering one end of each rail while its opposite end pivots relative to the frame for disposing the rails at a slight downwardly directed slope relative to the frame bottom edge for lowering and unclamping the plate from the frame so that the plate may be moved in a generally horizontal direction from beneath the frame.

5. A plate assembly as defined in claim 2, and said clamp mechanism being manually actuateable when desired.

6. A plate assembly as defined in claim 2, and said clamp mechanism including a pair of posts extending vertically downwardly through a portion of the frame, with each post having its lower end connected to a rail and its upper end connected to an actuator which moves the post upwardly and downwardly when the clamp mechanism is operated, for raising and lowering the rails.

7. A plate assembly as defined in claim 2, and including the lower edge of each of the frame side members having a channel extending the length of the member and opening downwardly, with the rails each fitted within a channel, but with each rail having an inwardly extending flange located beneath and supporting a side edge portion of the plate.

8. A plate assembly as defined in claim 7, and including each rail being generally L-shaped in cross-section with its generally horizontally extending leg portion arranged to fit beneath and to support a corresponding edge portion of the plate.

9. In a core machine having at least one of a sand delivery blow head, with a sand containing reservoir above the blow head for delivering sand through the blow head into a core box located beneath the blow head, or a gassing head with a gas source for supplying gas through the gassing head downwardly into a sand filled core box cavity, with the heads formed of a generally horizontally arranged, box-like frame opened at its bottom and having a closure plate covering the opening bottom and attached to the frame, with the plate having openings at locations aligned with corresponding core mold cavity locations within the core box arranged beneath the plate, the improvement comprising:

a pair of rails arranged beneath and secured to opposite lower edges of the frame and fasteners securing the rails to the frame;

the rails having edge portions extending towards each other, with the edge portions arranged beneath and supporting corresponding opposite edge portions of the plate;

said fastener being selectively adjustable upwardly and downwardly for raising the rails and the plate rested upon the rails upwardly to clamp the plate tightly against the lower edges of the frame for closing the frame tightly and for lowering the rails in order to correspondingly lower the plate downwardly relative to the frame;

said plate being generally horizontally moveable relative to the supporting rails and the frame when lowered relative to the frame so that a substitute plate may be positioned beneath the frame whenever the openings in the plate become partially or fully obstructed or when a different opening pattern in the plate is desired.

10. A core machine defined in claim 9, and including each of the rails being generally L-shaped in cross-section, with at least the vertical legs of the L-shaped loosely fitted within horizontally arranged, downwardly opening channels formed in the edge portions of opposed frame side members which form the frame and with the horizontal leg portions arranged beneath and supporting corresponding edge portions of the plate.

11. A core machine as defined in claim 10, and including said fastener having a fastener portion arranged at each of the opposite ends of the frame with posts connected to each of the opposite ends of the rails so that the rail opposite ends may be raised and lowered approximately simultaneously for clamping and lowering the plate relative to the frame.

12. A core machine as defined in claim 11, and including one end of each of the rails being pivotally connected to the frame with the opposite ends of the rails being moveable upwardly and downwardly relative to the frame by said fastener so that, upon actuation of the fastener, the rails are moved into a generally downwardly sloped arrangement relative to the bottoms of the frame side members and their channels for removal and replacement of the plate.

* * * * *